United States Patent [19]

Abbasi

[11] Patent Number: 4,846,665

[45] Date of Patent: Jul. 11, 1989

[54] FUEL COMBUSTION

[75] Inventor: Hamid A. Abbasi, Darien, Ill.

[73] Assignee: Institute of Gas Technology, Chicago, Ill.

[21] Appl. No.: 112,821

[22] Filed: Oct. 23, 1987

[51] Int. Cl.[4] ..... F23C 11/04

[52] U.S. Cl. ..... 431/1

[58] Field of Search ..... 431/1

[56] References Cited

U.S. PATENT DOCUMENTS

| | | | |
|---|---|---|---|
| 3,091,224 | 5/1963 | Rydberg | 431/1 |
| 3,708,980 | 1/1973 | Truxell | 60/274 |
| 3,982,393 | 9/1976 | Masaki et al. | 60/274 |
| 4,276,857 | 7/1981 | Martin | 431/1 |
| 4,403,941 | 9/1983 | Okiura et al. | 431/10 |
| 4,408,982 | 10/1983 | Kobayashi et al. | 431/10 |
| 4,500,281 | 2/1985 | Beardmore | 431/10 |
| 4,637,792 | 1/1987 | Davis | 431/1 |

FOREIGN PATENT DOCUMENTS 73265 3/1983 European Pat. Off. .

*Primary Examiner*—Margaret A. Focarino
*Attorney, Agent, or Firm*—Thomas W. Speckman; Douglas H. Pauley

[57] ABSTRACT

Process and apparatus for fuel combustion providing oscillation of fuel or combustion air provided to a burner to generate successive fuel-rich and fuel-lean zones in a flame thereby reducing $NO_x$ emissions.

17 Claims, 1 Drawing Sheet

FUEL COMBUSTION

BACKGROUND OF THE INVENTION

1. Field of the Invention

This invention relates to combustion of gaseous and vaporous fuels, particularly fossil-derived fuels, to reduce $NO_x$ emissions. This invention involves oscillation of fuel or combustion air provided to a burner to generate successive fuel-rich and fuel-lean zones in a flame.

2. Description of the Prior Art

Nitrogen oxides, primarily NO and $NO_2$ ($NO_x$) are a major cause of air pollution as a result of combustion processes.

It is generally recognized that fuel-rich and highly fuel-lean combustion conditions reduce $NO_x$ formation. There have been several attempts to utilize these conditions in combustion processes, usually involving multi-stage combustion. Multi-stage combustion wherein additional air or fuel is added downstream from the primary combustion is exemplified by the following publications. U.S. Pat. No. 4,403,941 teaches reduction of $NO_x$ in a multi-stage combustor having in succession a primary burner with fuel-rich incomplete combustion, a secondary burner with a fuel richer reducing combustion zone, and an after burner providing excess air for completion of combustion. U.S. Pat. No. 4,500,281 teaches another multi-stage combustion process wherein $NO_x$ emissions are reduced by having serially in open communication a fuel-rich combustion zone, introduction of a combustion catalyst, a second fuel-rich combustion zone, and a fuel-lean combustion zone. European Patent Publication 73265 teaches $NO_x$ reduction by having a fuel-rich primary combustion zone which abruptly terminates with introduction of combustion products and additional secondary air to a fuel-lean secondary combustion zone with prevention of backflow into the primary combustion zone.

U.S. Pat. No. 3,982,393 teaches cyclic combustion, as in an internal combustion engine, wherein some of the cylinders are provided fuel-rich mixtures and the remainder of the cylinders are provided fuel-lean mixtures with discharge from only the fuel-rich fed cylinders passing to an afterburner, the number of cylinders under each regime changing with low load engine operation and medium and high load engine operation. U.S. Pat. No. 3,708,980 teaches an internal combustion engine wherein alternate cylinders are supplied rich and lean fuel mixtures with the exhaust gases from the fuel-rich fed cylinders passing through an exhaust gas treating unit for reduction of $NO_x$ and the exhaust gas from all cylinders then conducted through an exhaust gas treating unit oxidizing hydrocarbons and carbon monoxide.

U.S. Pat. No. 4,408,982 teaches reduction of $NO_x$ produced by furnace combustion with alternate high/-low firing rates of fuel and oxidant involving aspiration of furnace gases into the oxidant jet with delay of oxygen injection at the start of the high firing rate. This patent teaches that alternate high-low firing rates of fuel and oxidant increases $NO_x$ emissions with oxygen enrichment. U.S. Pat. No. 4,637,792 is exemplary of pulse combustion patents wherein the rate of introduction of combustion mixtures to a combustion chamber is modified, but like the teachings of the '982 patent, the proportion of fuel and oxidant in the introduced mixtures remain constant.

SUMMARY OF THE INVENTION

It is an object of this invention to provide continuous combustion with decreased $NO_x$ formation.

It is another object of this invention to provide continuous combustion with decreased $NO_x$ formation which does not require major changes or modifications in burner or furnace design.

It is yet another object of this invention to provide lowered $NO_x$ emissions from existing combustors by relatively simple retrofitting without modification of the combustor itself.

It is still another object of this invention to provide a process and apparatus for fuel combustion which results in a stabilized flame.

The objects of this invention are achieved by providing an oscillating gas flow, such oscillations being in either the fuel or combustion air or oxidizer supply, to result in successive fuel-rich and fuel-lean supply of the combustible mixture by the burner which form successive fuel-rich and fuel-lean zones in the flame region of the combustion chamber. The fuel-rich and fuel-lean cycles are appropriately about 5 to 100 cycles per second, preferably about 5 to about 30 cycles per second. The stoichiometry within the fuel-rich and fuel-lean zones is controlled by periodicity of the flow rate of the flow being modified by any suitable flow modification device such as an electromechanical valve. The successive fuel-rich/fuel-lean zones are quite discrete near the burner with the frequency thickness being controlled by the frequency of oscillation. The thickness of the fuel-rich and fuel-lean zones may be the same or different and is controlled by the open time and close time of the control valve. Due to difference in velocities between the adjacent fuel-rich/fuel-lean zones in the combustion chamber caused by differences in temperature and flow in these zones, the zones tend to merge downstream for completion of combustion in a merged zone region of a single combustion chamber. Combustion of fuels generating primarily thermal derived $NO_x$ such as natural gas, should be carried out under non-adiabatic conditions to provide sufficient heat removal to assure low $NO_x$ forming conditions in the merged zone combustion region. Combustion of fuels generating primarily fuel derived $NO_x$, such as coal and heavy oils, may be carried out under either adiabatic or non-adiabatic combustion conditions.

Generally, the flow of either the fuel or combustion air is maintained constant while the flow of the other is subjected to alternating increase or decreases in accordance with this invention to result in the successive fuel-rich and fuel-lean waves or zones in the flame. It is preferred to oscillate fuel flow so as to provide constant combustion air flow, particularly when combustion air is preheated by passage through regenerators or recuperators. Combustion of this nature provides a stabilized flame with lowered $NO_x$ production. This invention is applicable to either gaseous or vaporous fuels.

BRIEF DESCRIPTION OF THE DRAWING

The above objects and advantages of this invention will become more clear upon reading preferred embodiments of the invention and by reference to the drawing wherein.

DESCRIPTION OF PREFERRED EMBODIMENTS

Figure 1:
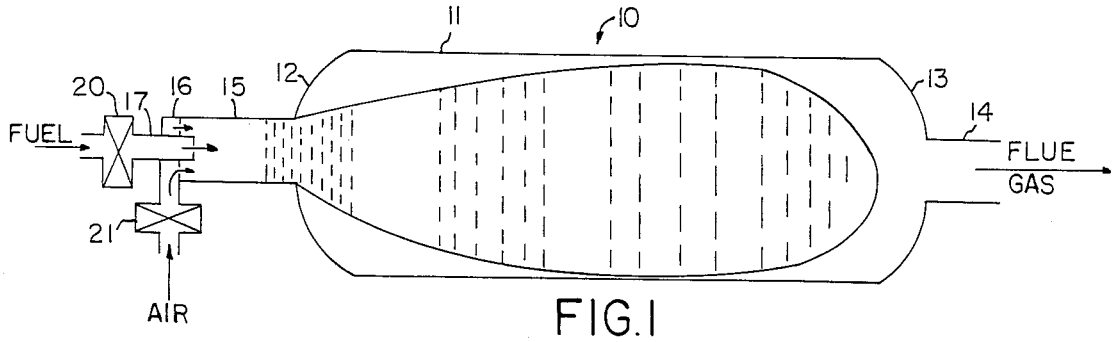
FIG. 1 is a highly stylized diagram of a combustor according to this invention with oscillation of fuel to air stoichiometry provided by pulsed fuel injection with constant combustion air injection.

FIG. 1 shows one embodiment of combustor 10 having side walls 11, burner end wall 12, and exhaust end wall 13 forming an essentially closed combustion chamber except for flue 14 to remove flue gas combustion products. Burner end wall 12 has burner 15 extending therethrough which may be any type of burner known to the art having various geometry of fuel and air introduction. As shown in FIG. 1, fuel introduction means 17 is shown as a nozzle with a surrounding combustion air introduction means annulus 16. A wide variety of burners are known to the art and are suitable for use in this invention as long as fuel and combustion air is introduced separately to the burner so that the flow of one of these supplies may be oscillated with respect to its requirement for combustion stoichiometry. The fuel and combustion air may be mixed prior to the burner, within the burner, or in the combustion chamber. Nozzle-type burners or port-type burners with side port, overport or underport firing may be used in this invention. While this invention is described using a single burner in a single combustion chamber, the invention is also applicable to use of multiple burners under conditions wherein the combustion chamber is sufficiently large so that each burner has its own discrete and non-conflicting flame path, at least at the introduction of the combustible mixture.

Figure 2:
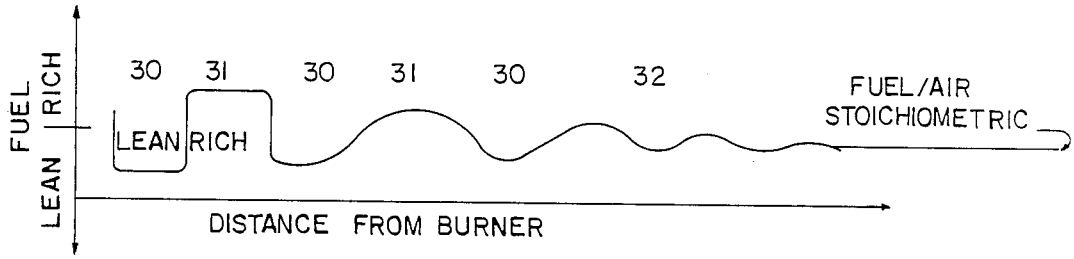
FIG. 2 is a diagrammatic showing of fuel/air oscillation shown in FIG. 1.

As shown in FIG. 1, fuel introductory means 17 is fed fuel in a cyclic fashion from flow adjustment means 20. Any gaseous or vaporous fuel may be used in the combustion of this invention including fossil derived and synthetic fuels. Gaseous, liquid, vaporized liquid, pulverized solid, and solid/liquid mixed fuels may be used. This invention is particularly applicable to fossil derived fuels which tend to form thermal or fuel derived $NO_x$ pollutants under combustion conditions. Preferred fuels include natural gas, synthetic natural gas (SNG), propane, and other mixtures comprising low molecular weight hydrocarbons, such as methane. Pulverized coals and vaporized oils, and fuels comprising $H_2$ and CO are also suitable. The fuel may comprise additives known to the art for specific purposes and may be preheated by any means known to the art, such as by thermal transfer capable of changing the amount of fuel supplied in from flue gases Flow adjustment means 20 is a cyclic manner with the amount of fuel being oscillatory with respect to the combustion stoichiometry of gas flowing from burner 15 or is capable of providing constant fuel flow, as desired. As shown in FIG. 1, combustion air is provided at a constant flow rate by flow control means 21 through combustion air introduction means 16. The term "combustion air" is used to mean atmospheric air and gas having higher oxygen content than atmospheric air. Oxygen-rich gas having significantly higher oxygen concentration than atmospheric air is suitable, such as industrial oxygen having about 75 volume percent oxygen and higher. The combustion air may be preheated by any means known to the art, such as by passage through a regenerator thermally charged by flue gases. Flow control means 21 may supply combustion air at a constant flow rate or in a cyclic manner with the amount of combustion air being oscillatory with respect to combustion stoichiometry. These manners of flow adjustment may be achieved by reducing the size of the opening supplying fuel or combustion air thereby increasing the velocity of the supplied fuel or combustion air and by changing the pressure of the supplied fuel or combustion air through the same size opening by alternating supplies of differing pressures. Both control means 21 provides relatively constant flow of these means of operation can be achieved by known electromechanical devices such as solenoids activated by electric frequency generators through an electric relay. As shown in FIG. 1, flow of combustion air by blower means known to the art. Constant combustion air flow with pulsing of the fuel flow in such a manner provides oscillation of the combustible gas flow, fuel plus combustion air, from the burner or adjacent the burner in the combustion chamber with respect to a fuel-rich and fuel-lean stoichiometry. As seen in FIGS. 1 and 2, expanding bands or zones of fuel-rich and fuel-lean stoichiometries are emitted from burner 15 radiating outward into the combustion zone with a major portion, over about 50 percent and preferably about 70 to about 90 percent, of the combustion being effected under the fuel-rich and fuel-lean combustion stoichiometries of the varying zones. The thickness of these zones is controlled by the frequency of flow adjustment and by the ratio of high or on flow time to low or off flow time. Suitable frequencies for oscillating fuel-rich/fuel-lean zones are about 5 to 100 cycles per second, about 5 to about 30 cycles per second being preferred. The oscillating valve should remain open about 20 to about 80 percent of the total cycle time. For a burner designed for stoichiometric natural gas firing with ambient air as combustion air, the variance in fuel content of the fuel-rich and fuel-lean zones at the burner should vary in amounts represented by the fuel-rich zone being about 30 to about 50 percent fuel excess of combustion stoichiometry and the fuel-lean zone being about 30 to about 50 percent fuel deficient of combustion stoichiometry, preferably about 40 to about 50 percent fuel excess and about 40 to about 50 percent fuel deficient, respectively. These ranges may vary for other fuels, fuel and air temperature, and different burner designs. Suitable overall fuel/air stoichiometry, the integrated stoichiometry of the cycle for specific fuels and combustion conditions may be readily ascertained by one skilled in the art knowing the process of this invention and adjusted as desired. For most combustion, about 5 to about 20 percent excess air is desired. As these fuel-rich and fuel-lean zones pass downstream through the combustor, due to the differing velocities of their introduction to the combustion chamber and due to turbulence and temperature conditions created by combustion within the flame region, these zones tend to merge toward the downstream end of the combustion chamber as shown in the figures to provide complete combustion. The same pulsed stoichiometric oscillations of fuel with respect to combustion air may be achieved by providing a steady fuel feed to the burner and oscillating air supply to air introduction means 16.

To maintain low $NO_x$ emissions according to the combustion process of this invention from fuels generating primarily thermal $NO_x$, the combustion should be non-adiabatic by removal of about 10 to about 50 percent of the heat produced by the combustion. This heat removal may be achieved by conventional thermal transfer means in the flame region or combustor shell to remove heat from the combustor prior to the merged fuel-rich/fuel-lean zones.

The following examples set forth specific materials and embodiments in detail and are only intended to exemplify the invention and not to limit it any way.

EXAMPLE

An Eclipse Model 3.0NMP-S nozzle mix burner, nominally rated at 25,000 Btu/hr, was installed in the end of a cylindrical combustion chamber. Natural gas fuel flow to the burner was passed through a high frequency 12 volt DC automotive EG control solenoid valve having 6 ms response. The solenoid valve was controlled by supply from a DC power supply with one side passing through a mercury relay switch having 1 ms response, the mercury relay switch cycled by a frequency generator. The natural gas fuel flow to the burner was measured by an in-line rotameter installed several feet upstream of the solenoid to provide stable flow measurements. Flue gas constituents were measured at the combustor exit using a water-cooled probe and continuous gas analyzers. The burner was first operated on steady natural gas flow with differing excess air levels as indicated followed by operation of the burner at the indicated cyclic fuel flow, the time-averaged fuel flow rate being maintained constant at the steady flow level.

The combustor used was 1-½ inch inside diameter by 8 inches long low carbon steel pipe providing 16 cu.in. volume and externally insulated by a one inch thick ceramic fiber blanket. The firing rate was 12,000 Btu/hr and firing intensity volumetric was $1.3\times10^6$ Btu/ft$^3$-hr and cross-sectional was $0.9\times10^6$ Btu/ft$^2$-hr. Results are shown in Table I:

TABLE I

| Fuel Oscillating Frequency No./sec | Excess Oxygen* % | $NO_x$ Measured ppm | $NO_x$ Air Free ppm |
|---|---|---|---|
| 0 | 5.2 | 45 | 60 |
| 0 | 3.2 | 60 | 70 |
| 0 | 1.4 | 66 | 71 |
| 0 | 0.9 | 68 | 71 |
| 40 | 4.3 | 52 | 66 |
| 40 | 2.8 | 57 | 66 |
| 40 | 1.4 | 58 | 62 |
| 40 | 0.7 | 59 | 61 |
| 20 | 6.0 | 41 | 57 |
| 20 | 4.2 | 49 | 61 |
| 20 | 2.3 | 51 | 57 |
| 20 | 0.9 | 51 | 53 |
| 20 | 0.2 | 46 | 46 |
| 10 | 4.9 | 36 | 46 |
| 10 | 2.2 | 37 | 41 |
| 10 | 1.2 | 33 | 35 |
| 10 | 0.6 | 31 | 32 |
| 10 | 0.4 | 31 | 31 |
| 7 | 2.6 | 30 | 34 |
| 7 | 1.2 | 24 | 26 |

*20 percent of excess air level

Results show effective decreases in $NO_x$ formation, especially at lower fuel oscillation frequencies and lower excess air levels: fuel oscillating frequencies of 7 per second showing reduction of $NO_x$ (air free) as compared to constant fuel flow of about 65 percent reduction at 5 percent excess air and about 57 percent reduction at 10 percent excess air.

EXAMPLE II

The combustion system described in Example I was modified by using a 2 inch inside diameter, 18 inches long combustion chamber having an inside volume of 57 cubic inches, made of vacuum-formed ceramic fiber 2 inches thick. This combustion chamber provided three times greater residence time. The burner nozzle diameter was halved to significantly increase gas/air mixing. The firing rate was 13,200 Btu/hr providing firing intensity volumetric of $0.4\times10^6$ Btu/ft$^3$-hr and cross-sectional of $0.6\times10^6$ Btu/ft$^2$-hr. A larger, somewhat slower conventional solenoid was used to allow higher fuel flows. Results are shown in Table II:

TABLE II

| Oscillating Frequency No./sec | Excess Oxygen, % | $NO_x$ Measured ppm | $NO_x$ Air Free ppm |
|---|---|---|---|
| 0 | 6.0 | 42 | 59 |
| 0 | 4.2 | 52 | 65 |
| 0 | 0.6 | 68 | 70 |
| 50 | 6.0 | 40 | 56 |
| 50 | 4.0 | 51 | 63 |
| 50 | 0.7 | 62 | 64 |
| 35 | 6.6 | 41 | 60 |
| 35 | 4.2 | 46 | 58 |
| 35 | 1.5 | 60 | 65 |
| 35 | 0.3 | 65 | 66 |
| 25 | 5.0 | 50 | 66 |
| 25 | 0.7 | 63 | 65 |
| 25 | 0.1 | 60 | 60 |
| 15 | 5.0 | 60 | 79 |
| 15 | 0.6 | 63 | 65 |
| 7 | 5.0 | 60 | 79 |
| 7 | 2.0 | 52 | 58 |

The data in Table II does not show significant $NO_x$ reduction with fuel flow oscillation, even at low excess air levels. This is believed to be caused by the highly effective insulation of the combustion chamber walls causing higher temperature in the downstream region of merging fuel-lean and fuel-rich zones resulting in high thermal $NO_x$ formation in this downstream merging region.

EXAMPLE III

The combustion system described in Example I was modified by using a 2.1 inch inside diameter, 18 inches long combustion chamber having an inside volume of 60 cubic inches, made of stainless steel and externally insulated by a one inch thick ceramic fiber blanket. The same burner and solenoid valve as described in Example I was used. The firing rate was 14,400 Btu/hr and firing intensity volumetric was $0.4\times10^6$ Btu/ft$^3$-hr and cross-sectional was $0.6\times10^6$ Btu/ft$^3$-hr. Results are shown in Table III:

TABLE III

| Oscillating Frequency No./sec | Excess Oxygen % | $NO_x$ Measured ppm | $NO_x$ Air Free, ppm |
|---|---|---|---|
| 0 | 5.0 | 24 | 32 |
| 0 | 2.5 | 33 | 38 |
| 0 | 1.6 | 36 | 39 |
| 0 | 1.0 | 48 | 50 |
| 0 | 0.6 | 48 | 50 |
| 0 | 0.0 | 44 | 44 |
| 30 | 4.6 | 24 | 30 |
| 30 | 2.0 | 24 | 27 |
| 30 | 1.0 | 24 | 25 |
| 30 | 0.0 | 23 | 23 |
| 20 | 5.0 | 27 | 35 |
| 20 | 2.8 | 24 | 28 |
| 20 | 1.6 | 22 | 24 |
| 20 | 0.6 | 20 | 21 |
| 10 | 5.0 | 35 | 46 |
| 20 | 3.0 | 20 | 23 |
| 10 | 1.8 | 18 | 20 |
| 10 | 1.0 | 16 | 17 |
| 10 | 0.5 | 8 | 8 |

TABLE III-continued

| Oscillating Frequency No./sec | Excess Oxygen % | $NO_x$ Measured ppm | $NO_x$ Air Free, ppm |
|---|---|---|---|
| 10 | 0.2 | 8 | 8 |
| 5 | 1.0 | 8 | 8 |

Results show effective decreases in $NO_x$ formation, especially at lower excess air, showing at 5 percent excess air and oscillating frequencies of 10 per second and 5 per second reductions of 66 percent and 84 percent, respectively.

EXAMPLE IV

The combustion system described in Example III was modified only by complete removal of the external insulation. Results are shown in Table IV:

TABLE IV

| Oscillating Frequency No./sec | Excess Oxygen, % | $NO_x$ Measured, ppm | $NO_x$ Air Free, ppm |
|---|---|---|---|
| 0 | 4.5 | 9 | 12 |
| 0 | 2.9 | 19 | 22 |
| 0 | 1.8 | 27 | 30 |
| 0 | 0.7 | 31 | 32 |
| 0 | 0.0 | 36 | 36 |
| 30 | 5.4 | 14 | 19 |
| 30 | 1.3 | 14 | 15 |
| 30 | 0.6 | 16 | 17 |
| 30 | 0.2 | 16 | 16 |
| 20 | 5.0 | 15 | 20 |
| 20 | 2.7 | 14 | 16 |
| 20 | 1.6 | 13 | 14 |
| 20 | 0.6 | 6 | 6 |
| 20 | 0.3 | 9 | 9 |
| 10 | 4.8 | 22 | 29 |
| 10 | 1.8 | 36 | 39 |
| 10 | 0.8 | 16 | 17 |
| 10 | 0.5 | 30 | 31 |
| 5 | 4.6 | 24 | 30 |
| 5 | 1.6 | 15 | 16 |

The above results show decrease of $NO_x$ with steady flow fuel as compared with Example III, thought to be due to higher heat removal from the combustion chamber. At 5 percent excess air, fuel oscillating frequencies of 20 per second provided about an 84 percent reduction in $NO_x$ emissions However, further decreases in fuel oscillating frequency resulted in higher $NO_x$, possible due to unstable flame resulting from combustion chamber wall temperature below natural gas ignition temperatures.

The above examples show reduction in the flue gas $NO_x$ of up to over 80 percent achieved by the process of this invention. Higher $NO_x$ the fuel-rich and ruel-lean oscillations provided reduction was observed at lower excess air levels with lower oscillating frequencies and with moderate heat removal from the combustor. These conditions are consistent with operation of most industrial burners and combustors. Higher CO emissions were generally observed with low $NO_x$ emissions and can be burned out with enhanced mixing. The process of this invention has a wide range of applications for both gas and oil firing of commercial and industrial boilers and water heaters to heavy industrial processes such as glass melting. The process of this invention is particularly useful for regenerative combustors, such as regenerative glass melters, since combustion air flow may be maintained constant.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a process for fuel combustion, the improvement comprising: providing a relatively constant flow rate of one of fuel and combustion air to a burner, providing a continuous and cyclically variable flow rate of the other of said fuel and said combustion air to said burner, passing said fuel and said combustion air from the exit of said burner to a combustion zone creating successive fuel-rich and fuel-lean zones radiating outwardly from said burner exit into said combustion zone, and combusting a major portion of said fuel in said fuel-rich and fuel-lean zones providing continuous combustion and decreased $NO_x$ formation, said combustion being non-adiabatic by removal of about 10 to about 50 percent of produced heat from said fuel-rich and fuel-lean zones.

2. In a process of claim 1 wherein said fuel-rich and fuel-lean total cycle is repeated about 5 to about 100 times per second.

3. In a process of claim 1 wherein said fuel-rich and fuel-lean total cycle is repeated about 5 to about 30 times per second.

4. In a process of claim 1 wherein said continuous and cyclically variable flow rate is provided fuel-rich at said burner for about 20 to about 80 percent of the total cycle time.

5. In a process of claim 1 wherein said fuel-rich zone at said burner exit comprises about 30 to about 50 percent fuel in excess of combustion stoichiometry.

6. In a process of claim 1 wherein said fuel-rich zone at said burner exit comprises about 40 to about 50 percent fuel in excess of combustion stoichiometry.

7. In a process of claim 1 wherein said fuel-lean zone at said burner exit comprises about 30 to about 5 percent fuel in deficiency of combustion stoichiometry.

8. In a process of claim 1 wherein said fuel-lean zone at said burner exit comprises about 40 to about 50 percent fuel in deficiency of combustion stoichiometry.

9. In a process of claim 1 wherein said fuel is provided at said continuous and cyclically variable flow rate.

10. In a process of claim 1 wherein said fuel comprises fuel selected from the group consisting of gaseous, liquid, vaporized liquid, pulverized solids, and mixtures thereof.

11. In a process of claim 1 wherein said fuel comprises gaseous fuel selected from the group consisting of natural gas, synthetic natural gas, propane, methane, hydrogen and carbon monoxide, and mixtures thereof.

12. In a process of claim 1 wherein said combustion air is supplied in amounts of about 5 to about 20 percent in excess of combustion stoichiometry based upon total fuel flow.

13. In a process of claim 1 wherein said fuel-rich and fuel-lean total cycle is repeated about 5 to about 100 times per second, said continuous and cyclically variable flow rate is provided fuel-rich at said burner for about 20 to about 80 percent of the total cycle time, said fuel-rich zone at said burner exit comprises about 30 to about 50 percent fuel in excess of combustion stoichiometry, and said fuel-lean zone at said burner exit comprises about 30 to about 50 percent fuel in deficiency of combustion stoichiometry.

14. In a process of claim 13 wherein said fuel is provided at said continuous and cyclically variable flow rate, and said fuel comprises natural gas and said combustion is non-adiabatic by removal of about 10 to about 50 percent of produced heat from said fuel-rich and said fuel-lean zones.

15. An apparatus for continuous fuel combustion with decreased $NO_x$ formation, said apparatus comprising: a combustor having at least one burner extending into a combustion chamber, flow control means providing a relatively constant flow rate of one of fuel and combustion air to said burner, flow adjustment means providing continuous and cyclically variable flow rate of the other of said fuel and said combustion air to said burner creating successive fuel-rich and fuel-lean zones radiating outwardly from said burner into said combustion chamber, means for combustion of a major portion of said fuel in said fuel-rich and fuel-lean zones, and means for removal of about 10 to about 50 percent of produced heat from said fuel-rich and said fuel-lean zones.

16. An apparatus of claim 15 wherein said adjustment means is capable of repeating said cyclically variable flow about 5 to about 100 times per second.

17. An apparatus of claim 15 wherein said adjustment means is capable of repeating said cyclically variable flow about 5 to about 30 times per second.

* * * * *